US008150307B2

(12) United States Patent
Kudo

(10) Patent No.: US 8,150,307 B2
(45) Date of Patent: Apr. 3, 2012

(54) CLEANING APPARATUS HAVING A FEEDING MEMBER AND A DRIVING MECHANISM AND IMAGE FORMING APPARATUS USING SAME

(75) Inventor: Toshihiko Kudo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/606,312

(22) Filed: Oct. 27, 2009

(65) Prior Publication Data

US 2010/0074666 A1 Mar. 25, 2010

Related U.S. Application Data

(62) Division of application No. 11/763,889, filed on Jun. 15, 2007, now Pat. No. 7,634,221.

(30) Foreign Application Priority Data

Jun. 19, 2006 (JP) ..... 2006-168714

(51) Int. Cl.
*G03G 21/12* (2006.01)

(52) U.S. Cl. ..... 399/360

(58) Field of Classification Search ..... 399/360, 399/358, 120, 261, 35
See application file for complete search history.

(56) References Cited

U.S. PATENT DOCUMENTS 4,650,312 A 3/1987 Vineski
4,958,196 A 9/1990 Fujii et al.
6,873,819 B2 3/2005 Ahn et al.
2004/0096251 A1* 5/2004 Ahn et al. ..... 399/360
2004/0146326 A1* 7/2004 Ahn et al. ..... 399/358

FOREIGN PATENT DOCUMENTS

JP 2001350382 A * 12/2001
JP 3302579 B2 4/2002
JP 2005049528 A * 2/2005
JP 2006-126434 A 5/2006
JP 2006126434 A * 5/2006

OTHER PUBLICATIONS

Machine English Translation of JP2006-126434.*
Machine English Translation of patent JP2006-126434 published on May 18, 2006.*

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus having a high toner containing efficiency of a waste toner-collecting container is provided. Piled toner is broken by an vibrating imparting operation and at the same time, a toner feeding member such as a feeding screw disposed inside the toner-collecting container is rotated by changing a reciprocating operation by the vibrating impartment to a rotational operation in a direction. As a result, the piled toner which cannot be completely broken by the vibrating imparting operation is broken and fed, so that driving noise is reduced and the toner containing efficiency is improved.

5 Claims, 10 Drawing Sheets

CLEANING APPARATUS HAVING A FEEDING MEMBER AND A DRIVING MECHANISM AND IMAGE FORMING APPARATUS USING SAME

This application is a divisional of U.S. patent application Ser. No. 11/763,889, filed Jun. 15, 2007, now U.S. Pat. No. 7,634,221, issued Dec. 15, 2009.

FIELD OF THE INVENTION AND RELATED ART

The present invention relates to an image forming apparatus, such as a copying machine or a printer, provided with a waste toner collecting means.

In a conventional image forming apparatus, e.g., a transfer type electrophotographic copying machine, toner used for development still remains in a small amount on a photosensitive drum as an image bearing member after a transfer operation. The transfer residual toner is removed from the photographic drum by a cleaning means. The thus removed toner is moved from the cleaning means to a waste toner-collecting container and contained in the collecting container as waste toner. In the waste toner-collecting container, it is desirable that the waste toner is contained in an amount as large as possible.

Japanese Patent Publication No. 3302579 has proposed a method of breaking piled waste toner collected and deposited by free fall in a waste toner-collecting container by moving a position of the collecting container in cooperation with insertion and removal of a sheet-feeding cassette.

Japanese Laid-Open Patent Application No. 2006-126434 has disclosed a constitution in which a waste toner accommodation efficiency is enhanced by imparting vibration to a waste toner-collecting container through impact during impingement of a vibrating lever against a cam member. This constitution includes a drive source for driving a feeding means for feeding a recording material, a driving force transmitting means for transmitting for transmitting a driving force during rotation in an opposite direction to rotation during the feeding of the recording material by the drive source, a vibration arm for imparting vibration to the waste toner-collecting container by the driving force transmitting means, and a guide means for guiding the vibration arm along a vibration direction. The drive source is rotated in the opposite direction for a predetermined time, so that vibration impartment to the waste toner-collecting container is effected by impact during the impingement of the vibration arm against the cam member.

In order to increase the toner accommodation efficiency of the waste toner-collecting container, provision of a toner-feeding member such as a screw has also been performed in general.

However, the waste toner has a high degree of aggregation, so that it is necessary to apply predetermined impact in order to break piled toner in the waste toner-collecting container. As a result, a noise of the impact is increased. For this reason, the impact noise is required to be suppressed to an acceptable level, so that it has been clarified that the piled toner cannot be completely broken.

The piled toner can also be broken by enhancing a feeding ability of the toner-feeding member. However, when the feeding ability is enhanced, the toner aggregates on one side of an inner space of the collecting container, so that an operational load of the toner-feeding member is increased.

SUMMARY OF THE INVENTION

A principal object of the present invention is to solve the above described problems.

An object of the present invention is to provide a cleaning apparatus and an image forming apparatus capable of breaking piled toner contained in a collecting container even when a toner feeding member has a low feeding ability.

According to an aspect of the present invention, there is provided a cleaning apparatus comprising:

a cleaning member for removing toner from an image bearing member;

a collecting container for collecting the toner removed by the cleaning member;

a feeding member, provided in the collecting container, for feeding the toner collected in the collecting member; and vibrating means for imparting vibration to the collecting container.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Image Forming Portion

Figure 2:
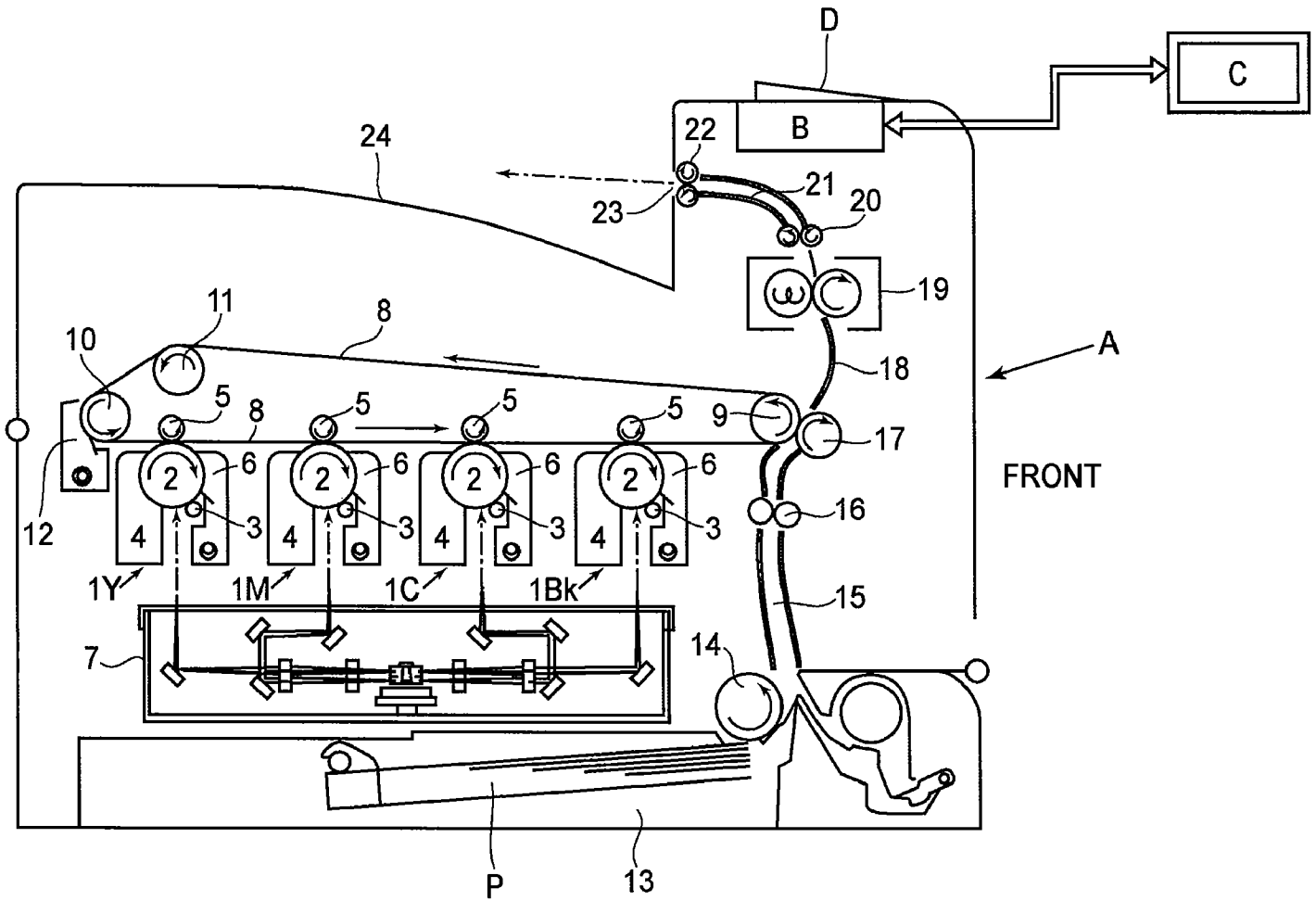
FIG. 2 is a schematic sectional view showing a constitution of an image forming apparatus in Embodiment 1.

FIG. 2 is a schematic sectional view showing a constitution of an electrophotographic full-color printer A as an example of the image forming apparatus according to the present invention.

This printer effects an image forming operation depending on input image information from an external host apparatus C communicatably connected with a control circuit portion (control board: CPU) B, thus being capable of forming and outputting a full-color image on a recording material. The external host apparatus C is a computer, an image reader, etc. The control circuit portion B sends a signal to the external host apparatus C, and receives a signal from the external host apparatus C. Further, the control circuit portion B effects image forming sequence control by sending signals to various image forming equipment and receiving signals from the various image forming equipment.

An intermediary transfer belt 8 which is an endless and flexible intermediary transfer member (hereinafter referred to as a "belt") is stretched among a secondary transfer opposite roller 9, a turn roller 10, and a tension roller 11 and rotationally driven in a counterclockwise direction indicated by an arrow at a predetermined speed by rotating the secondary transfer opposite roller 9. A secondary transfer roller 17 is pressed against the secondary transfer opposite roller 9 via the belt 8. A contact is portion between the belt 8 and the secondary transfer roller 17 is secondary transfer portion.

Four (first to fourth) image forming portions 1Y, 1M, 1C and 1Bk are disposed in series below the belt 8 with a predetermined spacing along a belt movement direction. Each image forming portion is an electrophotographic process mechanism of a laser exposure type and includes a drum-type electrophotographic photosensitive member 2 as an image bearing member (hereinafter referred to as a "drum") and is rotationally driven in a clockwise direction indicated by an arrow at a predetermined speed. Around each of drums 2, a primary charger 3, a developing apparatus 4 as a toner image forming means, a primary transfer roller 5, and a drum cleaning apparatus 6 as a first cleaning means are disposed. Each primary transfer roller 5 is disposed inside the belt 8 and is pressed against an associated drum 2 via a lower portion of the belt 8. A contact portion between each drum 2 and the belt 8 is a primary transfer portion. A laser exposure apparatus 7 is used for exposing a surface of the drum 2 to laser light and constituted by a laser emitting means for emitting light in correspondence with a time-serial electric digital pixel signal as input image information, and mirrors such as a polygon mirror, a reflection mirror, etc.

The control circuit portion B actuates each image forming portion to form an image on the basis of a color separation image signal inputted from the external host apparatus C. As a result, at the first to fourth image forming portions 1Y, 1M, 1C and 1Bk, color toner images of yellow, magenta, cyan, and black are formed, respectively, on an associated surface of rotating drum 2 at a predetermined timing. A method of forming a toner image on the drum will be described. The drum 2 is electrically charged uniformly by the primary charger 3 and is imagewise exposed to light emitted from the laser exposure apparatus 7 to form thereon an electrostatic latent image. On the basis of the formed electrostatic latent image, a toner image is formed by the developing apparatus 4. The toner image is transferred onto the belt 8 by the primary transfer roller 5. The toner remaining on the drum 2 after the transfer is removed by the cleaning apparatus 6. This image forming step is common to all the colors.

Each color toner image formed on the surface of the drum 2 at each image forming portion is successively transferred onto an outer surface of the belt 8, which is rotationally driven in the direction identical to the rotation direction of an associated drum 2 at a speed corresponding to the rotation speed of the associated drum 2, in a superposition manner at an associated primary transfer portion. As a result, on the surface of the belt 8, an unfixed full-color toner image consisting of superposed four color toner images is formed.

At a predetermined sheet feeding timing, a pickup roller is driven, so that a sheet of the recording material P stacked and contained in the sheet feeding cassette 13 is separated and fed to a registration roller pair 16 through a vertical sheet feeding path 15.

The registration roller pair 16 feeds the recording material P at a timing so that a leading end of the recording material P reaches the secondary transfer portion in synchronism with a timing at which a front end of the unfixed full-color toner image on the rotating belt 8 reaches the secondary transfer portion. As a result, at the secondary transfer portion, the unfixed full-color toner image on the belt 8 is successively secondary-transferred collectively onto the surface of the recording material P. The recording material coming out of the secondary transfer portion is separated from the surface of the belt 8 and guided by a vertical guide 18 into a fixing roller pair (hot-press roller pair) of a fixing apparatus 19. By the fixing apparatus 19, the unfixed full-color toner image is melted and color-mixed under application of heat and pressure to be fixed on the recording material surface as a permanently fixed image. The recording material P coming out of the fixing apparatus 19 is sent onto a sheet discharge (output) tray 24 as a full-color image formation product through an inner sheet discharging and feeding roller pair 20, a sheet feeding path 21, a sheet discharging and feeding roller pair 22, and a sheet discharging port 23.

The surface of the belt 8 after the separation of the recording material 9 is cleaned by removing a residual deposition on matter such as secondary-transfer residual toner or the like from the belt 8 by a belt cleaning apparatus 12 as a second cleaning means and is then repetitively subjected to image formation.

In the case of a monochromatic print mode, control of the image forming operation is effected with respect to only the fourth image forming portion 1Bk for forming the black toner image.

In each of the first to fourth image forming portions 1Y, 1M, 1C and 1Bk, four members including the drum 2, the primary charger 3, the developing apparatus 4, and the drum cleaning apparatus 6 are integrally formed into a unit as a process cartridge collectively detachably mountable in a main assembly of the printer.

Drive sources for the printer is not shown in is FIG. 2 but include an image formation drive motor for driving the drum 2 and the belt 8 at each image forming portion, a first development motor for driving the developing apparatuses 4 at the third and fourth image forming portions 1C (cyan) and 1Bk (black), a second development motor for driving the developing apparatuses 4 at the first and second image forming portions 1Y (yellow) and 1M (magenta), and a sheet feeding motor for driving the pickup roller 14. Further, the drive sources include a registration motor for driving the registration roller pair 16, a fixation motor for driving the fixing roller pair of the fixing apparatus 19 and the inner sheet discharging and feeding roller pair 20, and a sheet discharge motor for driving the sheet discharging and feeding roller pair 22. Of these motors, the image formation drive motor and the first and second development motors actuate the image forming portions. Further, the sheet feeding motor, the registration motor, the fixation motor, and the sheet discharge motor actuate the recording material feeding portion.

(2) Collection of Waste Toner

Collection of waste toner from the drum cleaning apparatuses 6 of the respective image forming portions 1Y, 1M, 1C and 1Bk and the belt cleaning apparatus 12 will be described.

In the following description, a longitudinal direction is a direction parallel to a rotation axis direction of the drum 2. Further, the terms "front", "rear", "left" and "right" are used on the basis of location of the printer when viewed from the front.

Figure 3:
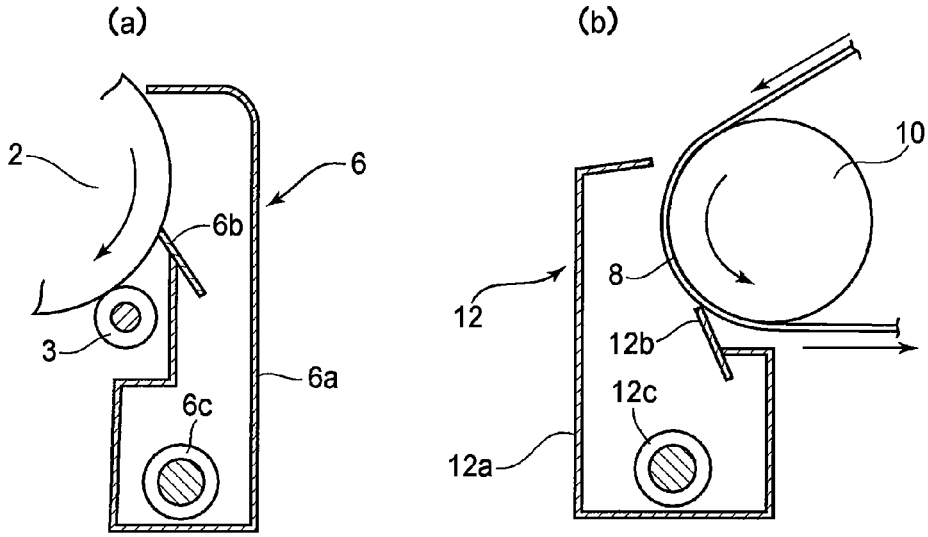
FIGS. 3(*a*) and 3(*b*) are enlarged schematic sectional views, wherein FIG. 3(*a*) shows a drum cleaning apparatus portion and FIG. 3(*b*) shows a belt cleaning apparatus portion.

In this embodiment, the drum cleaning apparatus 6 at each image forming portion is of a blade type. The drum cleaning apparatus 6 includes, as shown in FIG. 3(*a*), a cleaning container 6*a*, a cleaning blade 6*b* provided to the cleaning container 6*a* along a longitudinal inner edge of the cleaning container 6*a*, and a toner feeding screw shaft 6*c* disposed in the cleaning container 6*a*. The blade 6*b* is an elastic blade caused to contact the surface of the rotating drum 2 at its edge portion in a counter contact manner. The surface of the drum 2 is cleaned by the blade 6*b* during the rotation of the drum 2, so that primary-transfer residual toner on the drum surface is scraped and collected in the container 6*a*. The thus scraped toner is fed toward a left-hand end portion side in the container 6*a* by the rotation of the screw shaft 6*c*. At the left-hand end portion, a toner discharge opening is provided.

In this embodiment, the belt cleaning apparatus 12 is also of a blade type. The belt cleaning apparatus 12 includes, as shown in FIG. 3(*b*), a cleaning container 12*a*, a cleaning blade 12*b* provided to the cleaning container 12*a* along a longitudinal inner edge of the cleaning container 12*a*, and a toner feeding screw shaft 12*c* disposed in the cleaning container 12*a*. The blade 12*b* is an elastic blade caused to contact the surface of the rotating belt 8 at its edge portion in a counter contact manner. The surface of the belt 8 is cleaned by the blade 12*b* during the rotation of the belt 8, so that residual (untransferred) toner on the belt surface is scraped and collected in the container 12*a*. The thus scraped toner is fed toward a left-hand end portion side in the container 12*a* by the rotation of the screw shaft 12*c*. At the left-hand end portion, a toner discharge opening is provided.

Figure 4:
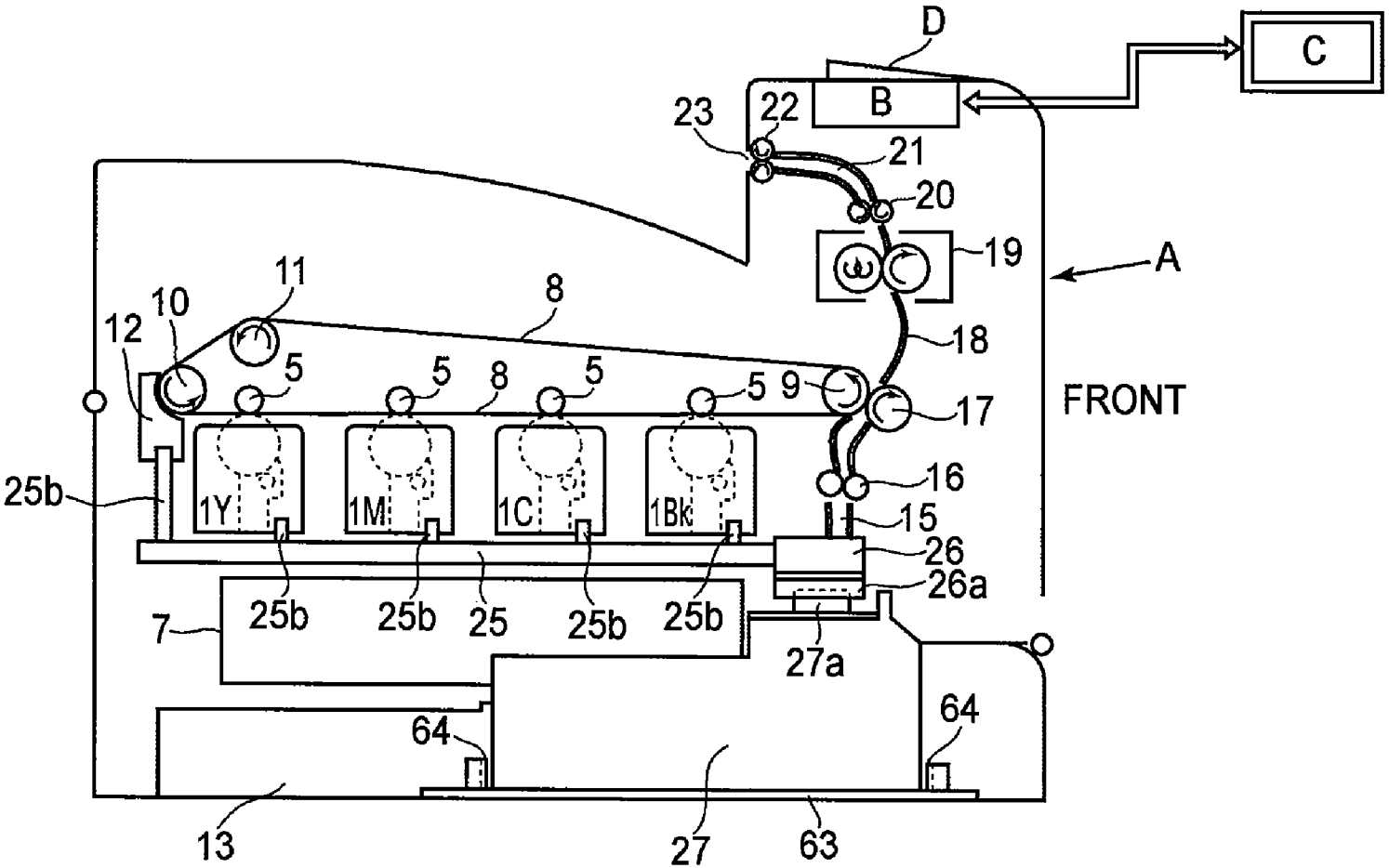
FIG. 4 is an explanatory view for a waste toner feeding pipe and a waste toner-collecting container.

In the main assembly of the printer, a long waste toner feeding pipe (means) 25 as shown in FIG. 4 is disposed in a front and rear direction on a left-hand end portion side. In the pipe 25, a toner feeding screw shaft 25*a* (FIG. 1) is contained. With respect to the pipe 25, a toner discharge opening of the drum cleaning apparatus 6 at each image forming portion and a toner discharge opening of the belt cleaning apparatus 12 are connected so as to communicate with each other through each of joint pipe portions 25*b*. As a result, the waste toner fed by the screw shaft 6*c* to the left-hand end portion side in the container 6*a* of the drum cleaning apparatus 6 at each image forming portion is discharged from the discharge opening into the pipe 25 through the joint pipe portion 25*b*. Further, the waste toner fed by the screw shaft 12*c* to the left-hand end portion side in the container 12*a* of the belt cleaning apparatus 12 is discharged from the discharge opening into the pipe 25 through the joint pipe portion 25*b*.

Further, on the left-hand end portion side in the main assembly of the printer, a toner-collecting container (waste toner bottle; hereinafter referred to as a "bottle") 27 as shown in FIG. 4 is disposed. An upper opening 27*a* of the bottle 27 and a front end portion of the pipe 25 are connected so as to communicate with each other through a joint portion (relay means) 26. The waste toner discharged from the drum cleaning apparatus 6 at each image forming portion and the belt cleaning apparatus 12 into the pipe 25 is fed toward a front end portion side by rotation of the screw shaft 25*a* in the pipe 25. The thus fed waste toner is contained in the bottle 27 by free fall from the joint portion 26 through the opening 27.

Figure 5:
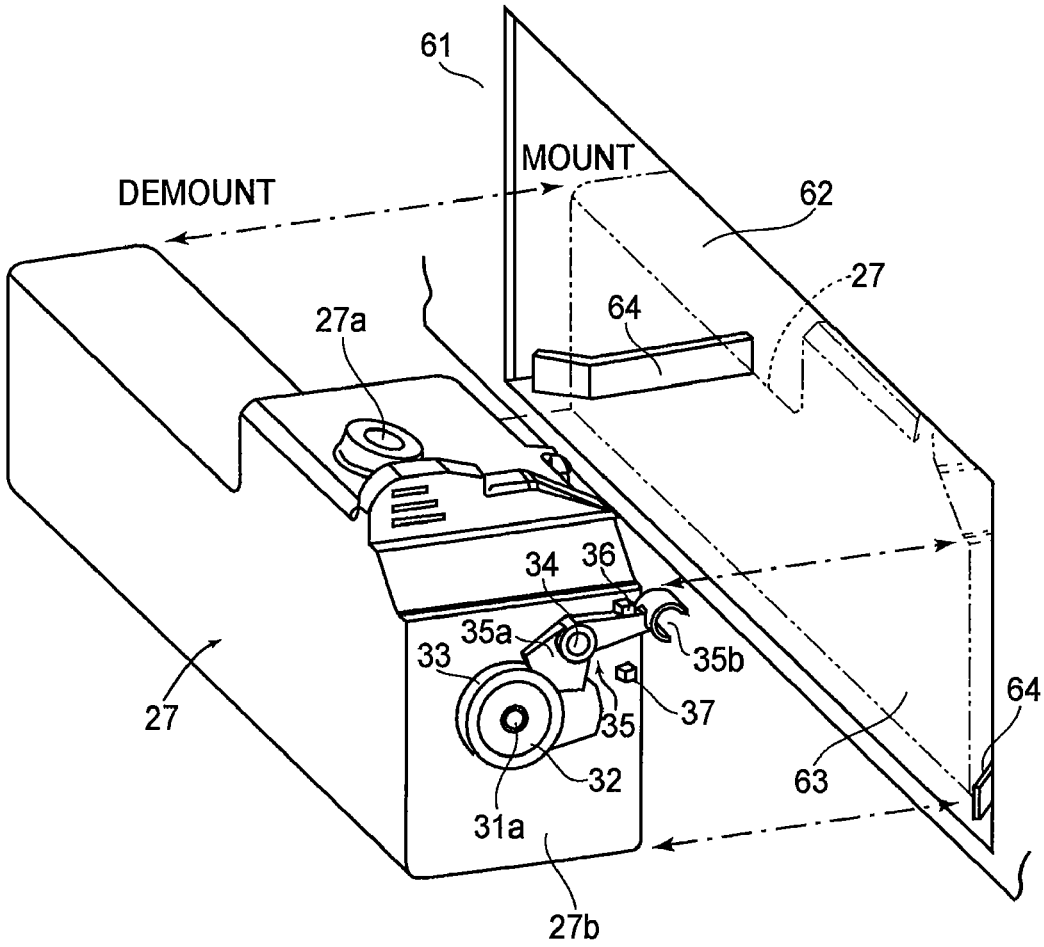
FIG. 5 is a schematic sectional view showing the waste toner-collecting container and its mounting portion.

The bottle 27 is mounted on and demounted from the main assembly of the printer through an opening 62 provided to a left-side surface plate 61 of the printer main assembly as shown in FIG. 5. In the case where the bottle 27 is filled with the waste toner, only the bottle 27 is removed from the inside of the printer main assembly and a blank bottle can be mounted. At the opening 62, an open/close cover or door is provided (not shown). To a bottle mounting table 63 in the printer main assembly, guide members 64 for defining front and rear positions of the bottle 27 mounted on the mounting table 63 are provided.

The joint portion 26 is attached to the front end portion of the pipe 25 and has a downward toner discharge portion. At a lower surface of the joint 26, a thick elastic sealing member 26*a* (FIGS. 1 and 4) is disposed so as to surround the toner discharge portion. The bottle 27 is inserted from the opening 62 into the printer main assembly with a predetermined attitude with respect to a front/rear direction and sufficiently pushed from a left direction to a right direction while sliding on the mounting table 63. As a result, an opening 27*a* on an upper surface of the bottle 27 is located under the joint portion 26 against elasticity of the elastic sealing member 26*a*, thus facing the toner discharge portion. That is, the opening 27*a* of the bottle 27 and the toner discharge portion of the joint portion 26 are placed in a connected state while communicating with each other via the elastic sealing member 26*a*. As a result, the toner discharged from the pipe 25 into the bottle 27 through the joint portion 26 is prevented from leaking out of the bottle 27.

When the bottle 27 is pulled out, from the right direction to the left direction, from the printer main assembly while sliding on the mounting table 63, the opening 27*a* on the upper surface of the bottle 27 comes out of the lower surface of the joint portion 26 against the elasticity of the elastic sealing member 26*a*, thus being disconnected from the joint portion 26. That is, only the bottle 27 is demounted from the inside of the printer main assembly.

(3) Improvement in Toner Accommodation Efficiency of Bottle 27

The piled the toner deposited in the bottle 27 by the free fall of the waste toner discharged from the front end portion of the pipe 25 into the bottle 27 through the joint portion 26 and the opening 27*a* is broken, so that it is possible to improve a waste toner accommodation efficiency of the bottle 27. For this reason, in the printer of this embodiment, the toner feeding member is provided in the bottle 27 and a vibration imparting means for vibrating the bottle is also provided. More specifically, the piled the deposition toner in the bottle 27 is broken by a vibration imparting operation of the vibration imparting means and a reciprocating operation for vibration impartment at this time is changed to a rotation operation in one direction to rotate the toner feeding member in the bottle 27, so that the piled toner which cannot be completely broken by the vibration imparting operation is broken and fed. As a result, it is possible to not only reduce a drive noise but also improve the waste toner accommodation efficiency of the bottle 27.

(3-1) Toner Feeding Member in Bottle

Figure 1:
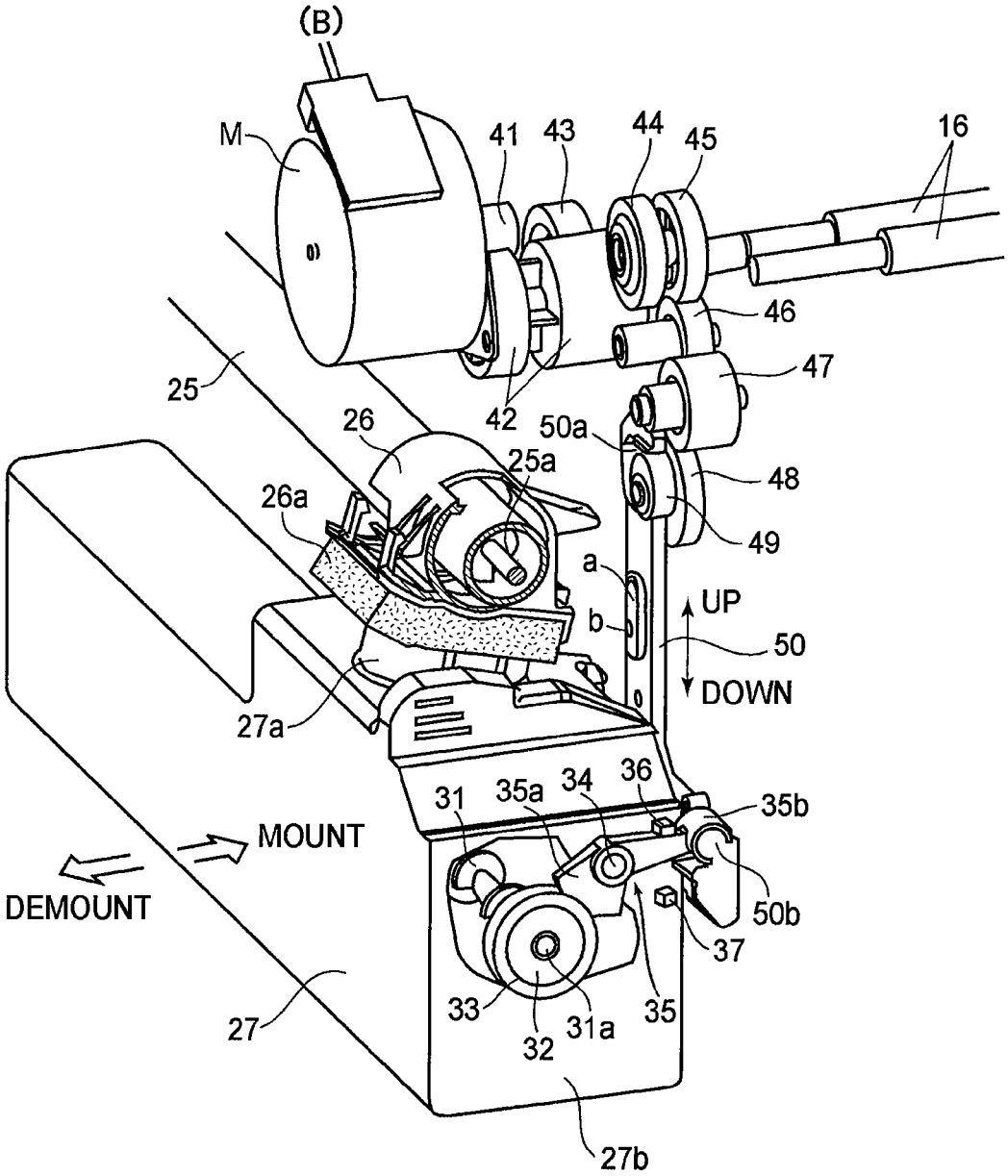
FIG. 1 is a partially exploded perspective view of a principal portion of a waste toner collecting means in Embodiment 1.
Figure 6:
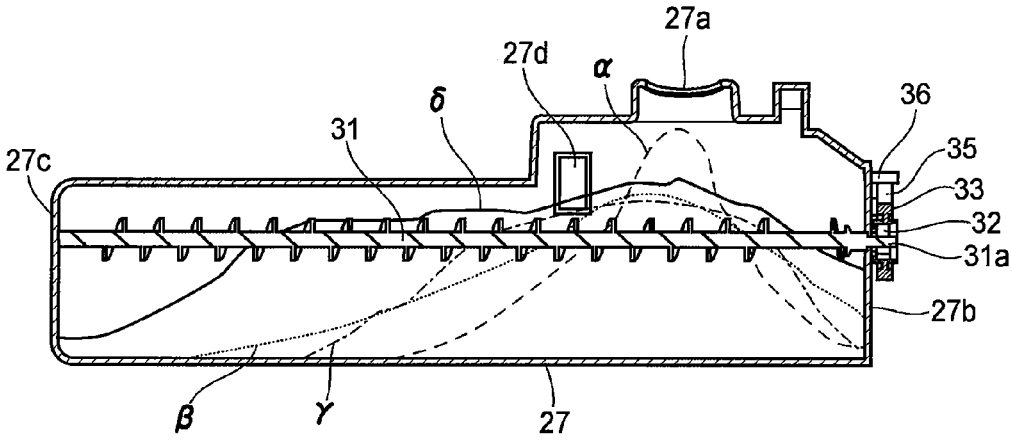
FIG. 6 is a longitudinal sectional view of the waste toner-collecting container.

As shown in FIGS. 1 and 6, inside the bottle 27, a toner feeding screw shaft (a toner feeding member) 31 elongated in the front/rear direction of the bottle 27 is provided by being supported by bearings between front and rear plates 27*b* and 27*c* of the bottle 27. A front end of the screw shaft 31 is caused to protrude from the bottle front plate 27*b* to the outside of the bottle 27 and to a protruded shaft 31*a* (the screw shaft front end), a bottle gear 33 is provided through a one-way clutch 33 (driving connection member). Further, outside the front plate 27*b*, as shown in FIGS. 1 and 5, a bottle lever 35 (moving member) rotatable about a supporting shaft 34 is provided. The bottle lever 35 has a sector gear portion 35*a*, as one arm portion thereof, which is engaged with the bottle gear 33. The bottle lever 35 has, as the other arm portion, a catcher portion 35*b* (engageable portion) formed of a plastic material having a C-shape and elasticity. A pivotable range of the bottle lever 35 is regulated so as to be an angle between an upper stopper portion (upper rotation regulating portion) 36 and a lower stopper portion (lower rotation regulating portion) 37 which are provided fixedly to the outer surface of the bottle front plate 27*b*.

As described later, the screw shaft 31 is rotated to fluidize the toner in the bottle 27, thus causing an occurrence of breakage of the piled toner deposited in the bottle 27.

(3-2) Bottle Vibration Imparting Means

Figure 7:
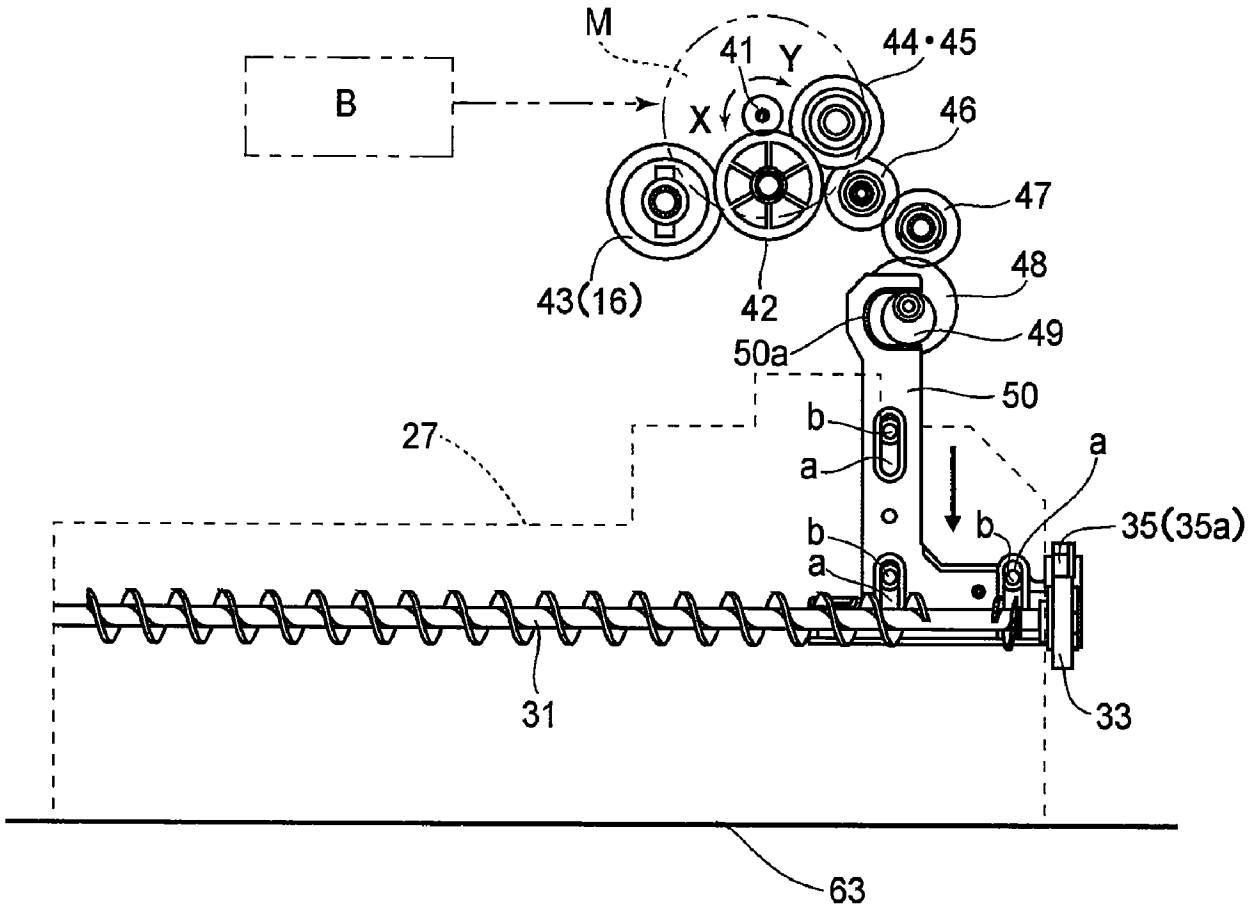
FIGS. 7 to 9 are schematic views each showing a vibrating mechanism portion.

In FIGS. 1, 7, 8 and 9, a registration motor M is controlled by the control circuit portion bottle so as to perform normal rotation drive, reverse rotation drive, and rotation drive stop. The control circuit portion B effects control of the registration motor M during an image forming (printing) operation of the printer so that the registration motor M is normally rotationally driven and stopped each at a predetermined timing. The normal rotation drive control of the registration motor M is control for rotating the registration roller pair 16 so that the recording material P is conveyed in a direction toward the secondary transfer portion. By the normal rotation control of the registration motor M, a drive gear 41 integrally supported by a motor shaft is rotated in a counterclockwise direction indicated by an arrow X as shown in FIG. 7. A normal rotation force of the drive gear 41 is transmitted to a registration roller gear 43 through an intermediary gear 42, so that the registration roller pair 16 is rotationally driven in a direction in which the recording material P is conveyed to the secondary transfer portion.

The intermediary gear 42 is engaged with a one-way clutch gear 44 which is idled above a gear supporting shaft during the normal rotation drive of the registration motor M. For this reason, a drive gear 45 integrally supported by the gear supporting shaft is not rotated.

When the registration motor M is reversely driven rotationally, the one-way clutch gear 44 is reversely rotated. A direction of the reverse rotation is a direction in which the clutch gear 44 is engaged with the gear supporting shaft, and the drive gear 45 is rotated together with the clutch gear 44 engaged with the gear supporting shaft. A rotation force of the drive gear 45 is transmitted to a cam gear 48 through intermediary gears 46 and 47, so that the cam gear 48 is rotationally driven.

At a side surface of the cam gear 48, an eccentric cam 49 is provided integrally with the cam gear 48. A vibration arm 50 which is an L-shaped flat plate is vertically movable by being guided by a vertically elongated hole a and a pin shaft b engaged in the hole a. The vibration arm 50 has a cam engaging concave portion 50*a* at an upper end portion thereof so that the recessed portion 50*a* has a horizontally concavely curved surface which conforms to a shape of the eccentric cam 49, so that the cam engaging recessed portion 50*a* is engaged with the eccentric cam 49. Further, at a lateral end portion of the vibration arm 50, a cylindrical connecting portion 50*b* is provided. Accordingly, the cam gear 48 is rotationally driven to cause eccentric rotation of the eccentric cam 49, so that the vibration arm 50 is vertically reciprocated with a stroke corresponding to a degree of eccentricity of the eccentric cam 49.

The above described registration motor M, gear train 41 to 49, and vibration arm 50 are supported by a vertical supporting plate (not shown) in a predetermined arrangement.

(3-3) Connection Between Bottle 27 and Vibration Arm 50

The catcher portion 35*b* provided to the bottle lever 35 on the bottle 27 side is detachably engaged with the cylindrical connecting portion 50*b*, so that the bottle 27 and the vibration arm 50 are connected to each other.

More specifically, as described above with reference to FIG. 5, the bottle 27 is inserted into the printer main assembly through the opening 62 of the left-hand side plate 61 with a predetermined attitude in the front/rear direction and is pushed sufficiently into the printer main assembly from the left direction to the right direction while sliding on the mounting table 63. As a result, the opening 27*a* at the upper surface of the bottle 27 is placed in a connection state to the joint portion 26 of the pipe 25. At the same time, the C-shaped catcher portion 35*b* on the bottle 27 side contacts the connecting portion 50*b* of the vibration arm 50 and is opened against the elasticity thereof by a pressing force, thus being externally engaged with the connecting portion 50*b*. As a result, the bottle lever 35 on the bottle 27 side and the vibration arm 50 are placed in the connection state.

A connecting operation in this case will be described with reference to FIGS. 11(*a*) and 11(*b*).

Both of a height position of the catcher portion 35*b* on the bottle 27 side and a height position of the connecting portion 50*b* on the vibration arm 50 side are not constant as to where these positions are located in a movable area.

Figure 11:
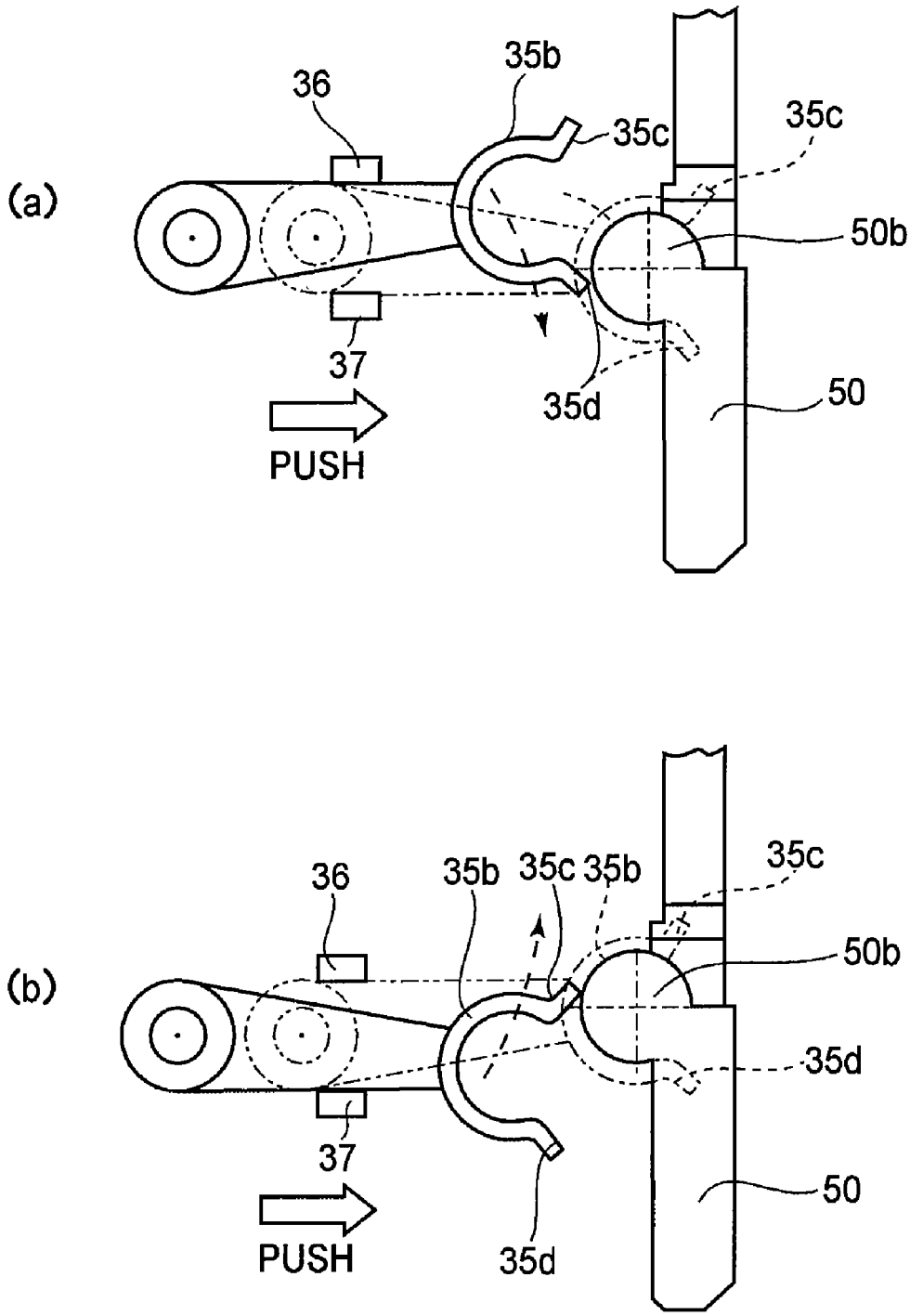
FIGS. 11(*a*) and 11(*b*) are explanatory views each for a connecting operation between a catcher portion of a bottle and a connecting portion of a vibration arm.

However, as shown in FIG. 11(*a*), when the catcher portion 35*b* is located at a highest position and the vibration arm 50 is located at a lowest position, a lower end 35*d* of the catcher portion 35*b* first contacts a lower portion of the outer periphery of the connecting portion 50*b* of the vibration arm 50. For this reason, the lower end 35*d* of the catcher 35*b* is guided downwardly along the outer periphery of the connecting portion 50*b*, so that the bottle lever 35 is connected to the vibration arm 50 while rotationally moving in a clockwise direction.

Next, as shown in FIG. 11(*b*), when the catcher portion 35*b* is located at a lowest position and the vibration arm 50 is located at a highest position, an upper end 35*c* of the catcher portion 35*b* first contacts an upper portion of the outer periphery of the connecting portion 50*b* of the vibration arm 50. For this reason, the upper end 35*c* of the catcher 35*b* is guided upwardly along the outer periphery of the connecting portion 50*b*, so that the bottle lever 35 is connected to the vibration arm 50 while rotationally moving in a counterclockwise direction.

As described above, even when the height position of the catcher portion 35*b* on the bottle lever 35 side end the height position of the connecting portion 50*b* on the vibration arm 50 side are located at any positions, the bottle lever 35 and the vibration arm 50 are connectable to each other.

Demounting of the bottle 27 from the printer main assembly is performed by pulling the bottle 27 from the right direction to the left direction toward the outside of the printer main assembly while the bottle 27 is caused to slide on the mounting table 63. As a result, the opening 27*a* on the upper surface of is the bottle 27 and the joint portion 26 are disconnected from each other and at the same time, the C-shaped portion of the catcher portion 35*b* on the bottle 27 side is opened against the elasticity thereof by a pulling force, thus being disengaged from the connecting portion 50*b* of the vibration arm 50. As a result, the engagement between the bottle 27 and the vibration arm 50 is released.

(3-4) Vibration Imparting Operation and Drive of Screw Shaft in Bottle

As described above, the registration motor M is controlled by the control circuit portion B during the image forming operation of the printer so that it is normally rotated and the normal rotation is stopped so as to convey the recording material P to the secondary transfer portion at a predetermined timing by the registration roller pair 16. The one-way clutch gear 44 is rotated during the normal rotation of the motor M but the rotation direction is an idling direction in which the gear 44 is idled above the gear supporting shaft, so that the drive gear integrally supported by the gear supporting shaft is not rotated. In other words, the vibration impartment to the bottle 27 by the vertical reciprocating motion of the vibration arm 50 and the drive of the screw shaft in the bottle 27 are not performed.

With the image forming operation of the printer, the toner collected in the bottle 27 is deposited in a deposition shape as indicated by a broken line a in FIG. 6. Reaching of an amount of the toner in the bottle 27 to a predetermined value is confirmed by detecting the time, when the toner reaches a detection window provided to the bottle 27, with a sensor (not shown). The control circuit portion B performs, on the basis of a toner detection signal from the sensor, a display operation for urging an operator to replace the bottle 27. When the deposition of the toner proceeds as it is, an inner space of the bottle 27 is placed in such a state that there is a large dead space in which the toner is not present, and a top of the deposition shape a (FIG. 6) reaches the upper surface opening 27*a* of the bottle 27 before the toner is deposited at a level of the detection window 27*d*.

For this reason, in the printer of this embodiment, not only the screw shaft 31 but also the vibration imparting means for vibrating the bottle 27 are provided in the bottle 27 as described above. During non-image formation of the printer, the piled toner deposited in the bottle 27 is broken by the vibration impartment operation. At the same time, the reciprocating operation by the vibration impartment is changed to the rotating operation in one direction to rotate the toner feeding screw shaft 31 in the bottle 27, so that the piled toner which cannot be completely broken by the vibration imparting operation is further broken and fed. As a result, the drive noise is reduced and the waste toner accommodation efficiency is increased.

The control circuit portion B is programmed so that it can control the registration motor M so as to be reversely rotated only for a predetermined time during the predetermined period of control timing when the printer is placed in the non-image formation state. By this reverse rotation control of the registration motor M, the drive gear 41 is rotated in the clockwise direction indicated by an arrow Y in FIGS. 7 and 8, so that the one-way clutch gear 44 is rotated in a direction opposite from that during the image formation. The rotation direction is a direction in which the gear 44 is engaged with the gear supporting shaft, so that the drive gear 45 actuates the transmission gear train 46 and 47 to rotationally drive the cam gear 48. By the rotation of the cam gear 48, the vibration arm 50 is vertically reciprocated with a stroke corresponding to a degree of eccentricity of the eccentric cam 49. With the reciprocating motion of the vibration arm 50, the bottle lever 35 connected to the connecting portion 50*b* of the vibration arm 50 via the catcher portion 35*b* is vertically moved rotationally about the supporting shaft 34.

Figure 8:
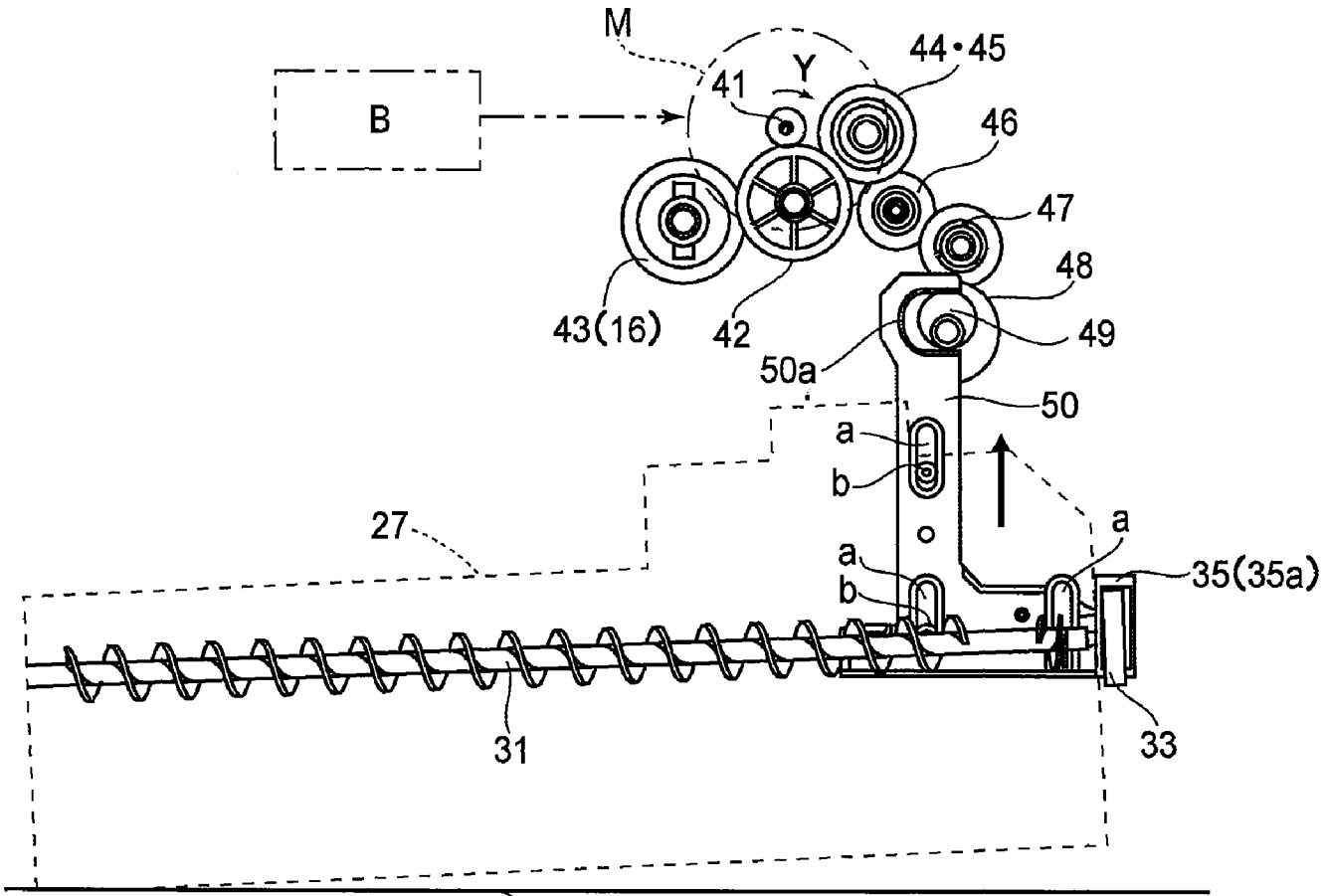
Figure 9:
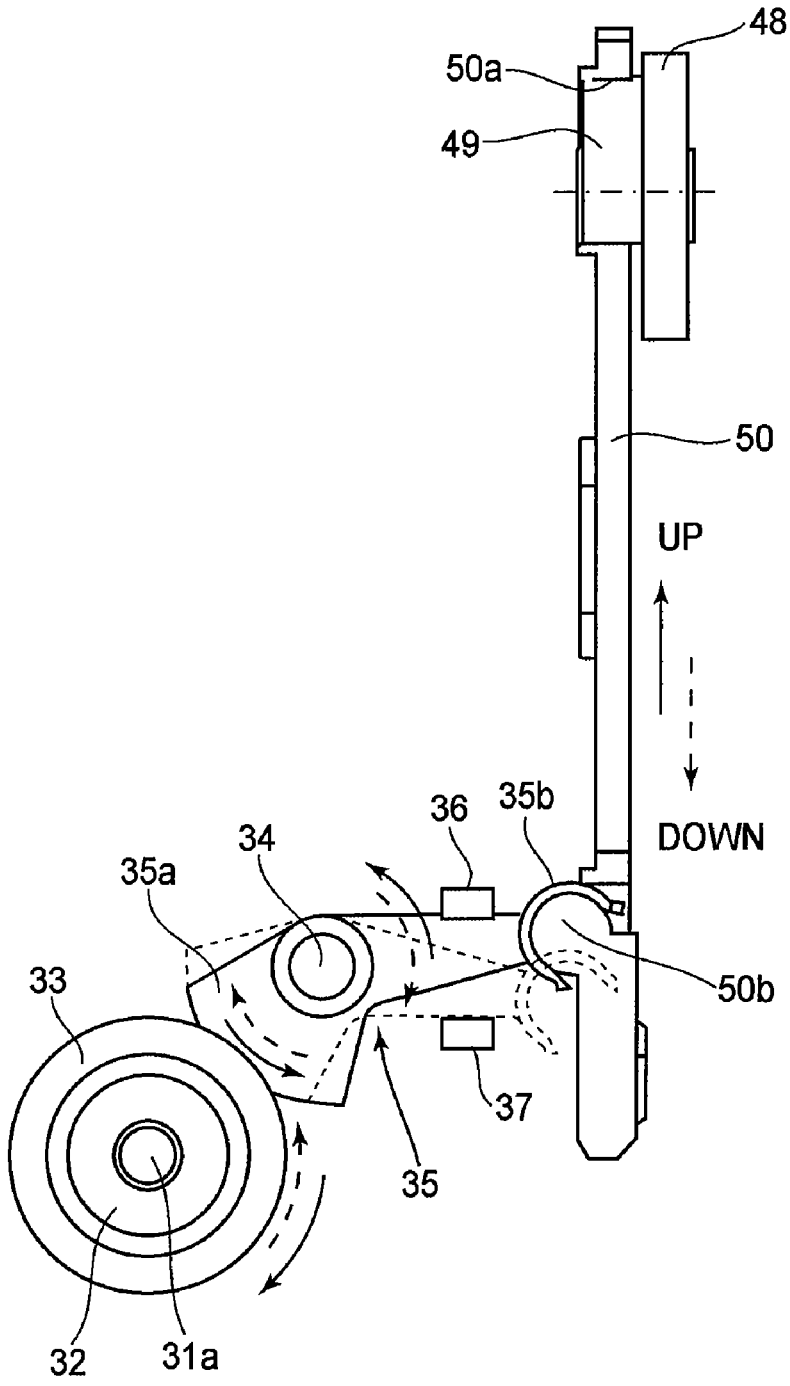

During the upward rotational movement of the bottle lever 35 with the upward movement of the vibration arm 50, the bottle lever 35 is stuck against and stopped by the upper-side stopper portion 36. By further upward movement of the vibration arm 50, the front side of the bottle 27 is raised by the bottle lever 35 struck against the upper-side stopper portion 36, so that a bottom surface of the bottle 27 is moved upwardly from the mounting table 63 with a rear bottom end of the bottle 27 as a fulcrum as shown in FIG. 8. When the vibration arm 50 reaches the upper limit of the upward movement, the vibration arm 50 is moved downwardly by further rotation of the cam gear 48. By this downward movement of the vibration arm 50, the front side of the bottle 27 is lowered, so that the bottom surface of the bottle 27 is placed in a state in which it is received and stopped by the mounting table 63 as shown in FIG. 7. By further downward movement of the vibration arm 50, the bottle lever 35 stopped by the upper stopper portion 36 is rotationally moved downwardly to the lower-side stopper portion 37. When the vibration arm 50 reaches the lower limit of the downward movement, the vibration arm 50 is upwardly moved again by further rotation of the cam gear 48.

As described above, by the vertical reciprocating motion of the vibration arm 50, the bottle 27 is vertically swung. By this vibration imparting operation, the piled toner deposited in the bottle 27 is caused to be broken.

The upper surface opening 27*a* of the bottle 27 and the joint portion 26 of the pipe 25 are connected through the thick elastic sealing member 26*a*. For this reason, the vertical movement of the upper surface opening 27*a* of the bottle 27 by the vibration imparting operation is performed with the elastic sealing member 26*a* as a cushion member against the joint portion 26. Accordingly, a sealing state between the upper surface opening 27*a* of the bottle 27 and the joint portion 26 is not broken during the vertical movement of the bottle 27 by the vibration imparting operation.

Further, with the vertical reciprocating motion of the vibration arm 50, the bottle lever 35 is vertically moved rotationally between the upper-side stopper portion 30 and the lower-side stopper portion 27 with the supporting shaft 34 as a center. As a result, the bottle gear 33 is normally rotated and reversely rotated by the sector gear 35*a* integrally supported with the bottle lever 35. During the upward rotational movement of the bottle lever 35 from the lower-side stopper portion 37 toward the upper-side stopper portion 36, the bottle gear 33 is normally rotated in the clockwise direction indicated by a solid line in FIG. 9. This normal rotation direction of the bottle gear 33 is a direction in which the one-way clutch 32 is idled above the shaft 31*a*, so that a rotational force is not transmitted to the screw shaft 31 in the bottle 27. On the other hand, during the downward rotational movement of the bottle lever 35 from the upper-side stopper portion 36 toward the lower-side stopper portion 37, the bottle gear 33 is reversely rotated in the counterclockwise direction indicated by a broken line in FIG. 9. This reverse rotation direction of the bottle gear 33 is a direction in which the one-way clutch 32 engaged with the shaft 31*a*, so that a rotational force is transmitted to the screw shaft 31 in the bottle 27.

More specifically, in the vertical reciprocation motion of the vibration arm 50, the screw shaft 31 in the bottle 27 is rotationally driven during the downwardly rotational movement of the bottle lever 35 from the upper-side stopper portion 36 toward the lower-side stopper portion 37 by the downward movement of the vibration arm 50. By this rotation of the screw shaft 31, the piled toner which cannot be completely broken by the vibration imparting operation is broken and fed.

As described above, in a predetermined period during the non-image formation of the printer, the registration motor M is controlled so as to be reversely rotated, so that the vertical reciprocating motion of the vibration arm 50 imparts vibration to the bottle 27. The reciprocating operation by the vibration impartment is changed to the rotational operation in one direction, so that the toner feeding screw shaft 31 in the bottle 27 is rotated to break and feed the piled toner which cannot be completely broken by the vibration imparting operation.

In the case of only the vibration imparting operation referring to FIG. 6, the deposition shape a of the piled toner in the bottle 27 before the vibration impartment is broken to be changed to a deposition shape β. However, in order to further feed the toner toward an inner rear end of the bottle, an impact force by the vibration impartment is required to be increased, so that an operation noise is also increased.

Further, in the case of only the rotation of the screw shaft 31, referring to FIG. 6, the deposition shape a of the piled toner in the bottle 27 before the vibration impartment is broken to be changed into a deposition shape γ. However, an edge (ridge) line is still in a high state although the top of the piled toner can be broken, so that the toner cannot be fed to the end corners of the inner space of the bottle 27.

In this embodiment, however, the vibration imparting operation and the toner feeding by the screw shaft 31 in the bottle 27 are performed at the same time, whereby the piled toner which cannot be completely broken by the vibration imparting operation is further broken and fed effectively. As a result, referring to FIG. 6, the deposition shape α of the piled toner in the bottle 27 before the vibration impartment is changed to a deposition shape δ, so that it is possible to contain a larger amount of the toner in the bottle 27. Further, the toner is also deposited reliably at the level of the detection window 27*d*, so that it is possible to stably detect the amount of the toner.

There is a possibility that the vibration by the vibration impartment to the bottle 27 adversely affects the image formation, so that the vibration impartment may desirably be performed during a period of the non-image formation. More specifically, the vibration impartment is performed after the image is fixed on the recording material P. The vibration impartment is effective when it is performed periodically, i.e., depending on frequency in use of the printer. For example, the vibration impartment is performed after a predetermined number of image formation is effected. Further, it is also possible to perform the vibration impartment after consumption of a predetermined amount of toner is confirmed by integrating an image duty.

Herein, as the period of the non-image formation, there are a premulti-rotation period, a standby period, a pre-rotation period, and a post-rotation period of the image forming apparatus. More specifically, the premulti-rotation period is an actuating operation period of the image forming apparatus after a main power switch of the image forming apparatus is turned on. The standby period is a period for awaiting input of an image formation start signal. The pre-rotation period is a pre-operation period for performing a pre-operation after the image formation start signal is inputted and before an image forming operation is started. The post-rotation period is a post-operation period for performing a post-operation after the image forming operation is completed and before the image forming apparatus is placed in a standby state.

During the non-image formation period, the recording material P is not interposed between the registration rollers 16, so that there is no problem even when the registration rollers 16 are reversely rotated by the reverse rotation control of the registration motor M. In other words, there is no problem for utilization of the reverse rotation of the registration roller driving motor M in vibration impartment.

However, in the case where the recording material P is interposed between the registration roller 16 at the time of an occurrence of jamming or the like even during the non-image formation period, the vibration impartment is not performed even when a vibration impart condition is satisfied. In this case, the vibration impartment is performed during a restoring operation after the jammed recording material P is removed.

In this embodiment, such a constitution that the vibration is imparted by reversely rotating the motor M for driving the registration rollers 16 is described above. However, other than the registration rollers 16, it is also possible to utilize, as a drive source for the vibrating means for the vibration arm, a drive source for driving conveyance rollers which do not convey the recording material P when the rollers are reversely rotated during the non-image formation period. For example, it is possible to employ a constitution in which the vibrating means is driven by utilizing reverse rotation of a fixation motor or a sheet discharge motor. It is also possible to provide a motor dedicated solely to the vibration impartment.

According to this embodiment, it is possible to achieve the following effects a to c.

a: It is possible to reduce the impact noise by realizing the vibration imparting operation through the operation interrelated with the eccentric cam, not through the impact by impingement between parts.

b: it is possible to complement a lowering in the toner feeding performance at the inner corner portions of the bottle when the screw blade does not affect in the case where the screw shaft is used as the toner feeding member in the bottle.

c: The L-shaped flat plate member (vibration arm) 50 is used for transmitting a driving force for imparting vibration, so that it is possible to reduce an arrangement space for the driving force transmitting means such as the gear train for driving the screw shaft 31 in the bottle 27 and reduce the number of parts. As a result, it is possible to improve design flexibility and reduce parts cost.

Embodiment 2

Figure 10:
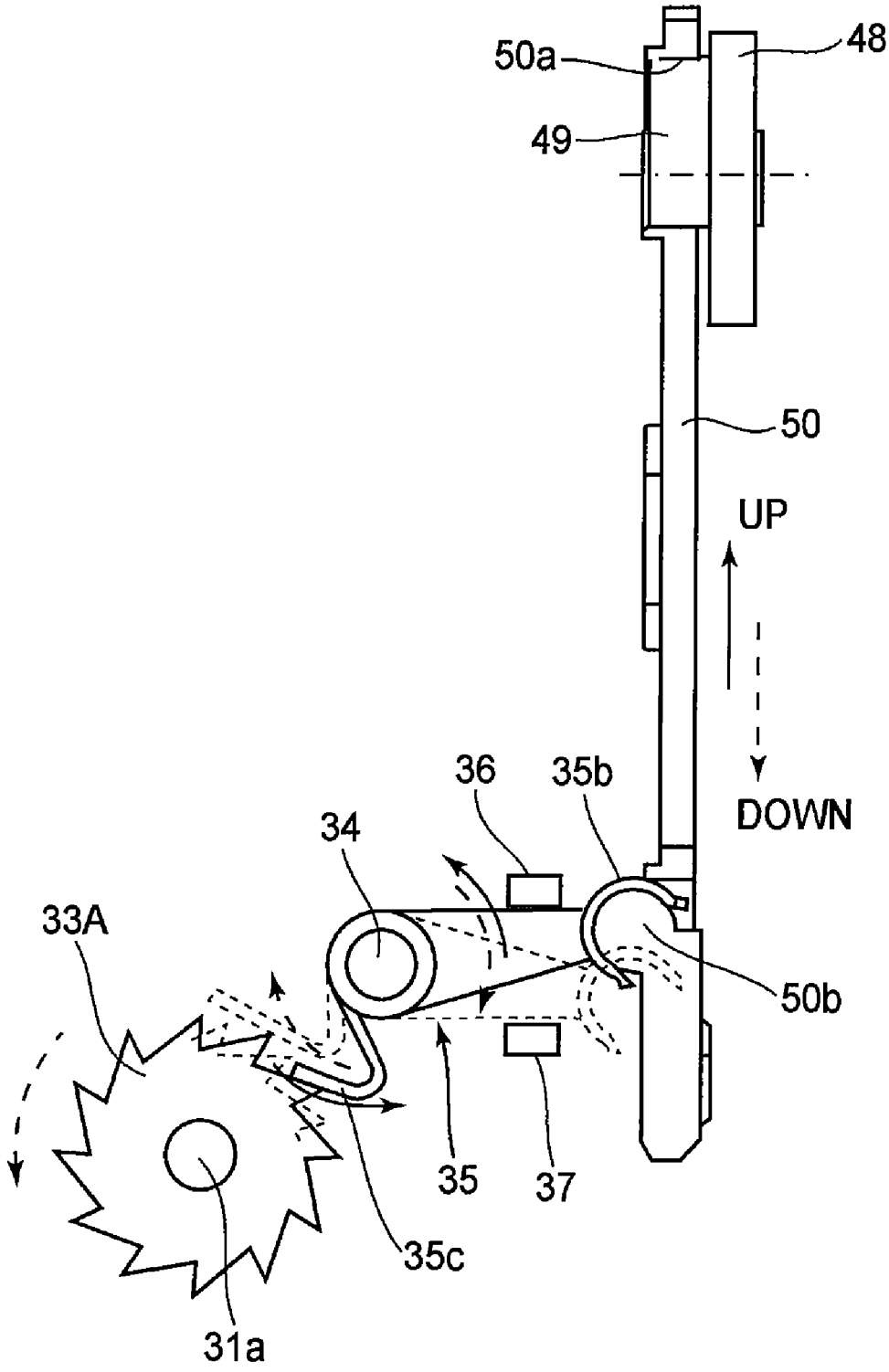
FIG. 10 is a schematic view showing a vibrating mechanism portion in Embodiment 2.

FIG. 10 is an explanatory view for illustrating a principal mechanism in this embodiment.

In FIG. 2, in the constitution of the bottle 27 used in Embodiment 1, a claw gear mechanism is used in place of the one-way clutch mechanism. More specifically, the one-way clutch 32 and the bottle gear 33 used in Embodiment 1 are changed to a claw gear 33A, which is fixedly attached to the front end portion 31*a* of the screw shaft 31. Further, the sector gear 35*a* of the bottle lever 35 is changed to a claw portion 35*c* formed of a V-shaped leaf spring. The claw gear 33A contacts an end of the claw portion 35*c*. Other constitutions of this embodiment are identical to those of Embodiment 1. Accordingly, redundant description will be omitted.

Similarly as in Embodiment 1, with the reciprocating motion of the vibration arm 50, the bottle lever 35 (engaging member) connected to the connecting portion 50*b* of the vibration arm 50 via the catcher portion 35*b* is vertically moved rotationally about the supporting shaft 34.

Further, by the vertical reciprocating motion of the vibration arm 50, the bottle 27 is vertically swung. By this vibration imparting operation, the piled toner deposited in the bottle 27 is caused to be broken.

Further, with the vertical reciprocating motion of the vibration arm 50, the bottle lever 35 is vertically moved rotationally between the upper-side stopper portion 30 and the lower-side stopper portion 27 with the supporting shaft 34 as a center. During the upward rotational movement of the bottle lever 35 from the lower-side stopper portion 37 toward the upper-side stopper portion 36, the claw portion 35*c* is rotated in the counterclockwise direction indicated by a solid line in FIG. 10, so that the end of the claw portion 35*c* is located corresponding to a recessed portion of the claw gear 33A (conversion member). In this state, a rotational force is not transmitted to the screw shaft 31 in the bottle 27. On the other hand, during the downward rotational movement of the bottle lever 35 from the upper-side stopper portion 36 toward the lower-side stopper portion 37, the claw portion 35*c* is rotated in the clockwise direction indicated by a broken line in FIG. 10, to push the recessed portion of the claw gear 33A, so that the claw gear 33 is rotated in the counterclockwise direction. In this state, the screw shaft 31 in the bottle 27 is rotated.

More specifically, in the vertical reciprocation motion of the vibration arm 50, the screw shaft 31 in the bottle 27 is rotationally driven during the downwardly rotational movement of the bottle lever 35 from the upper-side stopper portion 36 toward the lower-side stopper portion 37 by the downward movement of the vibration arm 50. By this rotation of the screw shaft 31, the piled toner which cannot be completely broken by the vibration imparting operation is broken and fed.

In this embodiment, instead of the one-way clutch mechanism used in Embodiment 1, the claw gear mechanism 35*c* and 33A is used. As a result, the image forming apparatus of this embodiment is reliably operable even in an environment in which scattered toner is deposited, thus achieving similar effects to those in Embodiment 1.

In Embodiments 1 and 2, the constitutions of the image forming apparatuses capable of effecting color print are described but the present invention is widely applicable to image forming apparatuses including waste toner collecting means, thus being also applicable to a white/black (monochromatic) image forming apparatus.

In the above described embodiments, the operation of the feeding member in the waste toner-collecting container is interrelated with the operation of the vibrating means. However, in the present invention, the operation of the feeding member may be performed independently of the operation of the vibrating means.

As described above, according to the present invention, the piled waste toner deposited in the collecting container is broken by the vibration imparting operation suppressed in impact noise and the vibration imparting operation is changed to the rotation operation in one direction to rotate the toner feeding member in the collecting container. By this rotation, the piled toner which cannot be completely broken by the vibration imparting operation is broken and fed effectively. As a result, it is possible to provide an image forming apparatus including a waste toner collecting means which is reduced in drive noise and improved in toner accommodation efficiency.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 168714/2006 filed Jun. 19, 2006, which is hereby incorporated by reference.

What is claimed is:

1. A cleaning apparatus comprising:

a cleaning member configured and positioned to remove toner from an image bearing member;

a collecting container configured and positioned to collect toner removed by said cleaning member;

a feeding member, provided rotatably in said collecting container, configured and positioned to feed toner in said collecting container; and a driving mechanism configured and positioned to rotate said feeding member and to swing said collecting container, wherein said driving mechanism includes a rotatable member provided rotatably on said collecting container, and wherein when said rotatable member is driven, said collecting container is swung and said feeding member is rotated.

2. The apparatus according to claim 1, wherein said driving mechanism comprises:

a projection provided on said collecting container so as to overlap with a rotation area of said rotatable member, which is configured and positioned to receive a driving force from said rotatable member and to swing said collecting container; and a driving gear that drives said rotatable member.

3. The apparatus according to claim 2, further comprising a driving-connecting member that transmits only a rotational driving force of said driving gear in one direction, wherein said feeding member is rotated in one direction by rotation of said rotatable member in a forward direction and a back direction.

4. An image forming apparatus comprising:

an image bearing member;

an image forming unit configured and positioned to form an image borne on said image bearing member on a recording material;

a cleaning member configured and positioned to remove toner from said image bearing member;

a collecting container configured and positioned to collect toner removed by said cleaning member;

a feeding member, provided rotatably in said collecting container, configured and positioned to feed toner in said collecting container; and a driving mechanism configured and positioned to rotate said feeding member and to swing said collecting container, wherein said driving mechanism includes a rotatable member provided rotatably on said collecting container, and wherein when said rotatable member is driven, said collecting container is swung and said feeding member is rotated.

5. The apparatus according to claim 4, further comprising a driving source configured and positioned to rotationally drive in a first direction and a second direction, wherein (i) when said driving source drives in the first direction, a conveying member conveys the recording material, and (ii) when said driving source drives in the second direction, said rotatable member rotates.

* * * * *